US007578698B1

(12) United States Patent
Thia et al.

(10) Patent No.: US 7,578,698 B1
(45) Date of Patent: Aug. 25, 2009

(54) USB STORAGE DEVICE

(75) Inventors: Kong Beng Terang Thia, Singapore (SG); Pei Koh Lee, Singapore (SG); Wei Loon Ng, Singapore (SG); Kah Liang Gan, Singapore (SG)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 12/111,365

(22) Filed: Apr. 29, 2008

(51) Int. Cl.
*H01R 13/60* (2006.01)

(52) U.S. Cl. ..... 439/528; 439/456

(58) Field of Classification Search ..... 439/501, 439/528, 160, 159, 456
See application file for complete search history.

(56) References Cited

U.S. PATENT DOCUMENTS

| | | | | |
|---|---|---|---|---|
| D272,342 | S | 1/1984 | Cheng | D14/435 |
| 4,496,155 | A | 1/1985 | Goldfarb | 273/153 |
| D354,752 | S | 1/1995 | Johnson et al. | D14/240 |
| D391,239 | S | 2/1998 | Carlson | D14/368 |
| D398,920 | S | 9/1998 | Yen | D14/358 |
| D412,326 | S | 7/1999 | Gianfagna et al. | D14/435 |
| D436,596 | S | 1/2001 | Ito et al. | D14/434 |
| D439,588 | S | 3/2001 | Bergstrom et al. | D16/203 |
| D444,788 | S | 7/2001 | Do et al. | D14/433 |
| 6,301,103 | B1 | 10/2001 | Abboud | 361/686 |
| D462,954 | S | 9/2002 | Chen | D14/299 |
| D481,389 | S | 10/2003 | Owen | D14/358 |
| 6,705,890 | B2 * | 3/2004 | Kitou et al. | 439/528 |
| 6,722,917 | B2 | 4/2004 | Huang | 439/501 |
| D518,640 | S | 4/2006 | Hoofnagle | D3/273 |
| D525,240 | S | 7/2006 | Hales et al. | D14/240 |
| 7,104,816 | B1 * | 9/2006 | Wang | 439/136 |
| D551,847 | S | 10/2007 | Yeap et al. | D3/201 |

OTHER PUBLICATIONS

Office Action dated Dec. 5, 2008 from U.S. Appl. No. 29/317,385.

* cited by examiner

*Primary Examiner*—Neil Abrams
*Assistant Examiner*—Phuong Nguyen
(74) *Attorney, Agent, or Firm*—Westman, Champlin & Kelly, P.A.

(57) ABSTRACT

A storage device includes a housing having a cavity formed therein which contains a storage unit. A USB cable is electrically connected between a USB plug located outside of the cavity of the housing and the storage unit located in the cavity. A USB cable stress relief mount includes a first USB cable clamp formed in the housing. A second USB cable clamp is formed in the housing and is opposed to the first USB cable clamp. A third USB cable clamp is formed in the housing. The third USB cable clamp is positioned at an angle with the first and second USB cable clamps. The USB cable extends between, and is secured by, the first, second and third USB cable clamps.

18 Claims, 7 Drawing Sheets

USB STORAGE DEVICE

BACKGROUND OF THE INVENTION

The present invention relates to storage devices. More specifically, the present invention relates to storage devices which couple to other electronics through a Universal Serial Bus (USB) connector.

Data storage device are utilized in many applications. Typically, the data storage device is mounted within a larger data system and is not configured for easy removal. However, there are many applications in which a removable data storage device is desirable.

Various types of removable data storage devices have been implemented including memory cards, external hard disc configurations, and others. One technique which is used for connecting an external data storage device to a data system is through a Universal Serial Bus (USB) connection. For the case of small USB storage devices, it may be possible for a USB plug to be fixably coupled to the housing of the USB device such that the entire storage device is "plugged" into an electronic data system such as a computer. However, in some instances, such as with the case of larger storage devices, a USB cable may be used to couple a USB plug to the USB to a storage unit contained within a housing. The USB plug can then be connected to a computer system or other device.

SUMMARY OF THE INVENTION

A storage device includes a housing having a cavity formed therein which contains a storage unit. A USB cable is electrically connected between a USB plug located outside of the cavity of the housing and the storage unit located in the cavity. A USB cable stress relief mount includes a first USB cable clamp formed in the housing. A second USB cable clamp is formed in the housing and is opposed to the first USB cable clamp. A third USB cable clamp is formed in the housing. The third USB cable clamp is positioned at an angle with the first and second USB cable clamps. The USB cable extends between, and is secured by, the first, second and third USB cable clamps.

Other features and benefits that characterize embodiments of the present invention will be apparent upon reading the following detailed description and review of the associated drawings.

DETAILED DESCRIPTION OF ILLUSTRATIVE EMBODIMENTS

As discussed in the Background section, some storage devices use a USB cable and USB connector for coupling to a data system such as a computer or other device. A storage unit is contained within a housing and electrically coupled to the USB cable. The present invention is directed to such a data storage system. The present invention addresses a number of issues to provide an aesthetically attractive, shock robust and reliable configuration.

One source of device failure is the electrical USB cable which couples to the storage unit. The wires in the cables can be fatigued or stressed with time and use. In order to strengthen the cabling and increase the longevity of the unit, prior art "strain relief" is typically in the form of a molded boot which surrounds the cable and is fitted to the housing. However, this configuration increases the size of the unit and requires a large tolerance with respect to the positioning of the strain relief mold on the cable. The present invention further includes aspects related to storing the USB plug within the housing a reliable technique as well as increasing the shock robustness of the housing.

Figure 1A:
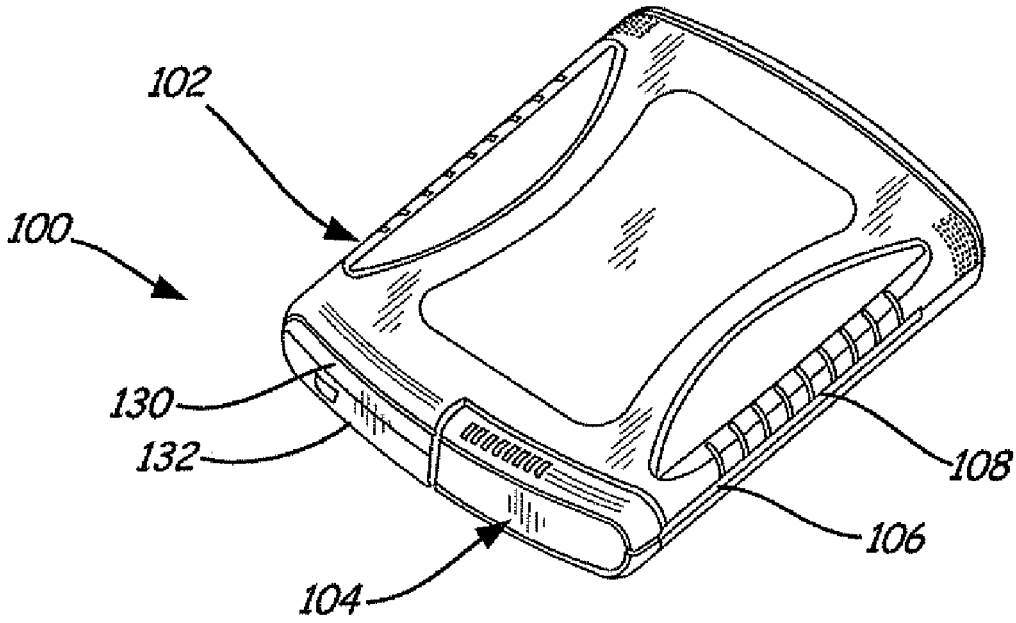
FIG. 1A is a top perspective view.
Figure 1B:
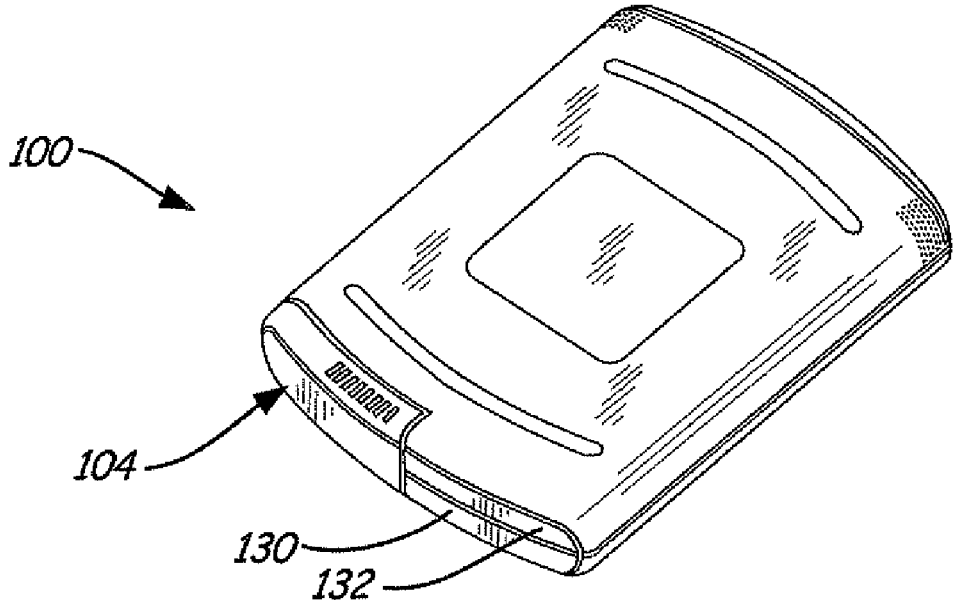
FIG. 1B is a bottom perspective view.
Figure 1C:
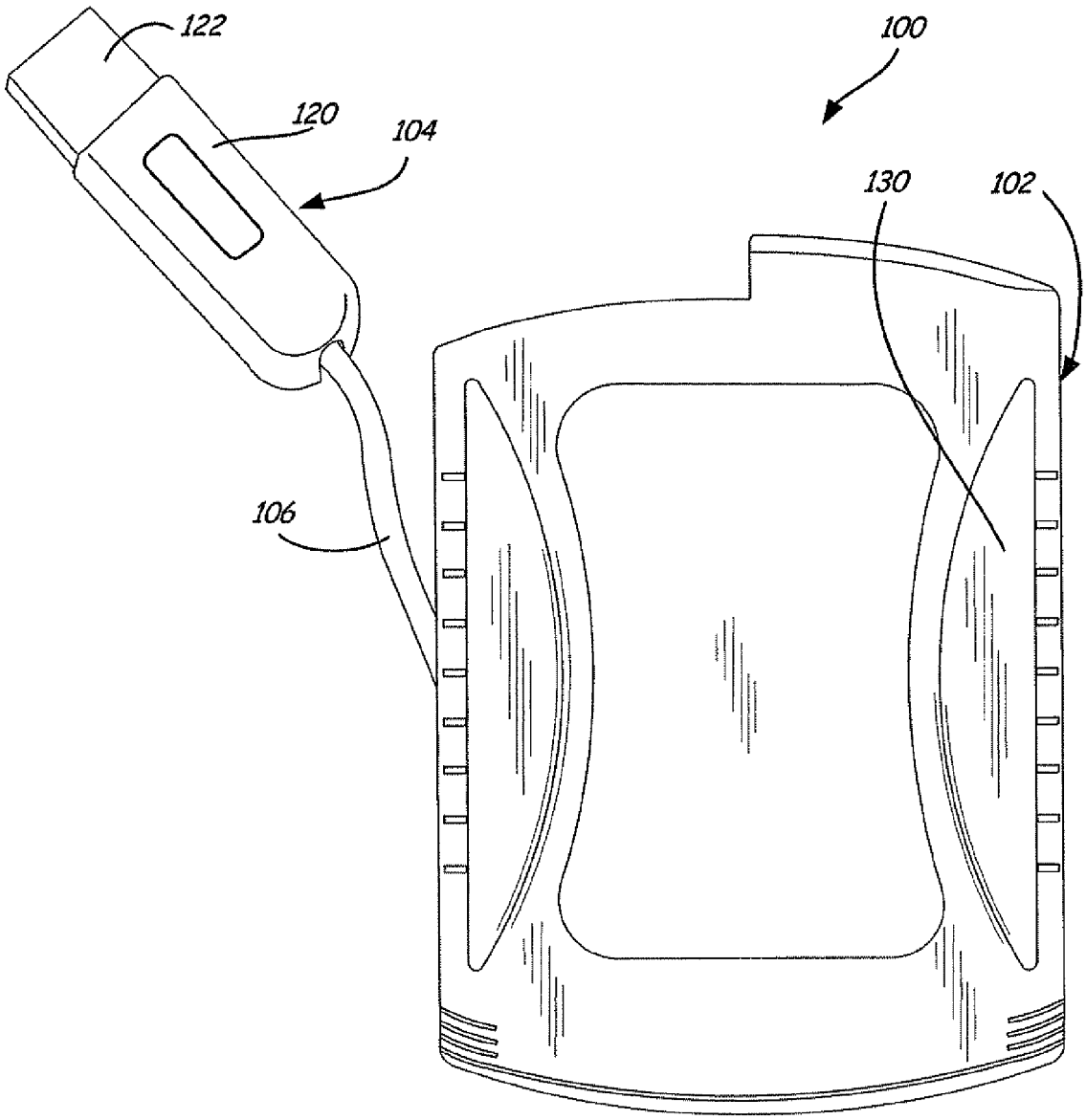
FIG. 1C is a top plan view and FIG. 1D is a top exploded perspective view of a USB storage device in accordance with the present invention.
Figure 1D:
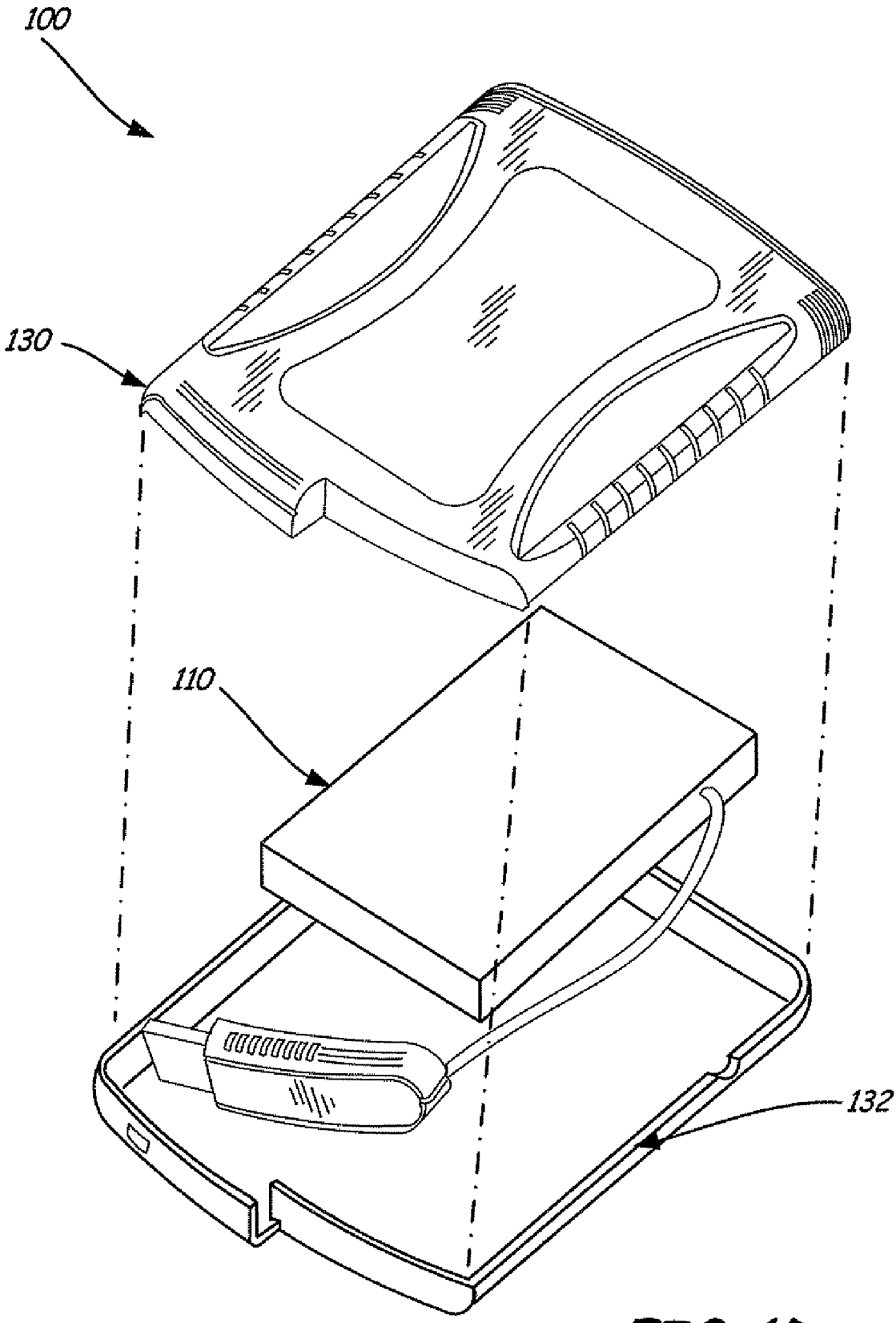

FIG. 1A is a top perspective view, FIG. 1B is a bottom perspective view, FIG. 1C is a top plan view and FIG. 1D is an exploded perspective view of USB storage device 100 in accordance with one example embodiment of the present invention. In FIGS. 1A and 1B, a USB plug 104 is shown in a stored position in housing 102. In FIG. 1C, the USB plug 104 has been removed from the stored position. Storage device 100 includes a housing 102 which couples to a Universal Serial Bus (USB) plug 104 through USB cabling 106. USB cabling 106 extends from the USB plug 104 to a storage unit 110 (see FIG. 1B). USB plug 104 includes a housing portion 120 and a connector portion 122.

As illustrated in FIG. 1B, housing 102 is formed of a top portion or section 130 and a lower housing or section 132. The storage unit 110 fits in a cavity formed between top and bottom sections 130 and 132. The storage unit may be in accordance with any appropriate technique including disc based techniques, solid state techniques, hybrid techniques, or others. Cable 106 extends through the housing 102 to outside of the housing 102. Cable 106 fits within a groove 108 formed between top section 130 and lower housing section 132 of housing 102.

Figure 2A:
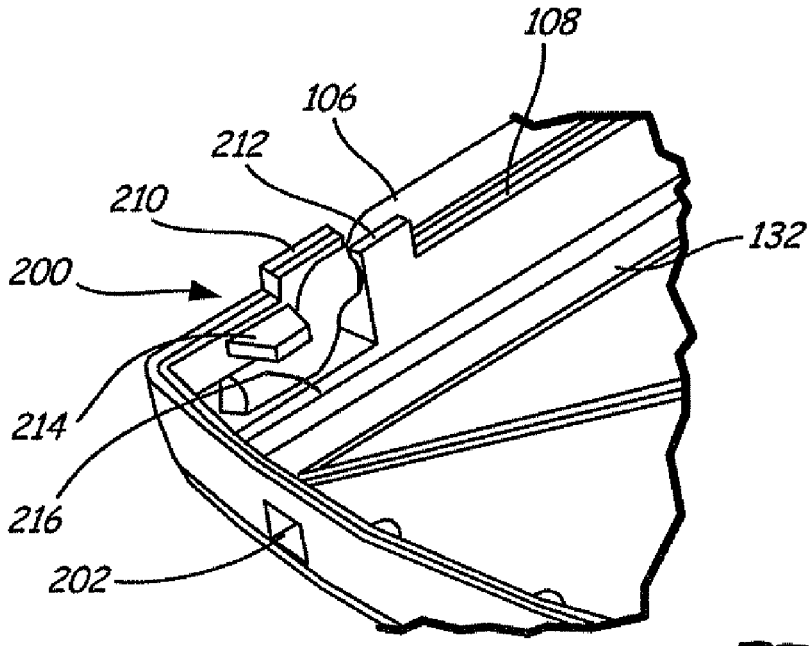
FIG. 2A is a cut-away view of a portion of a bottom section of the housing of FIG. 1 showing a cable of strain relief.
Figure 2B:
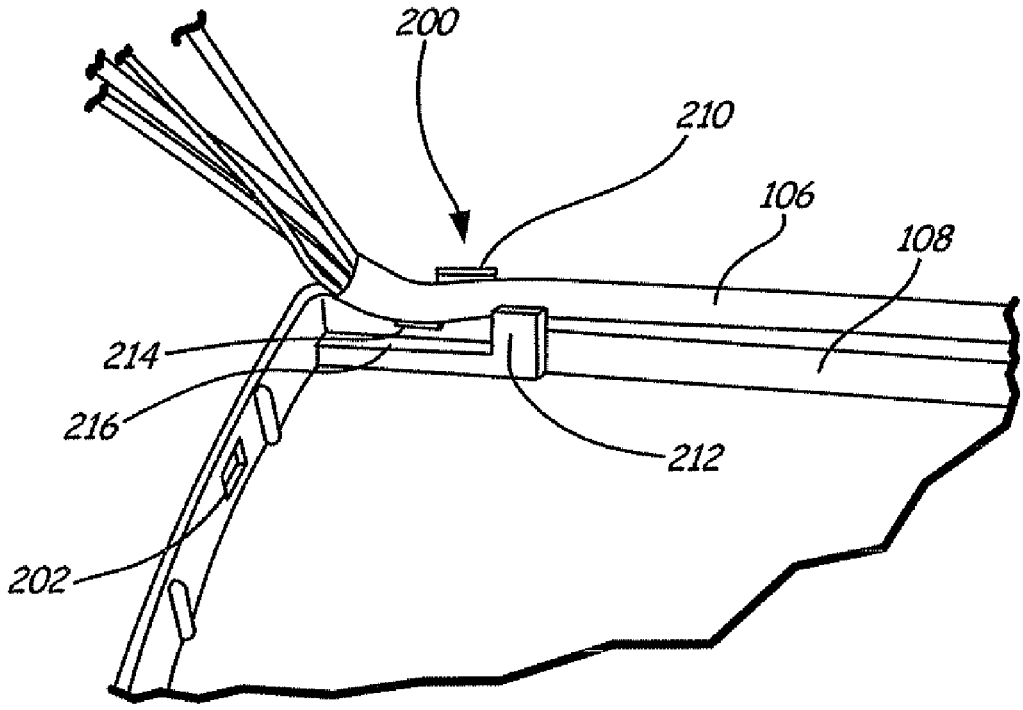
FIGS. 2B, 2C and 2D illustrates steps of placing a USB cable strain relief shown in FIG. 2A.
Figure 2C:
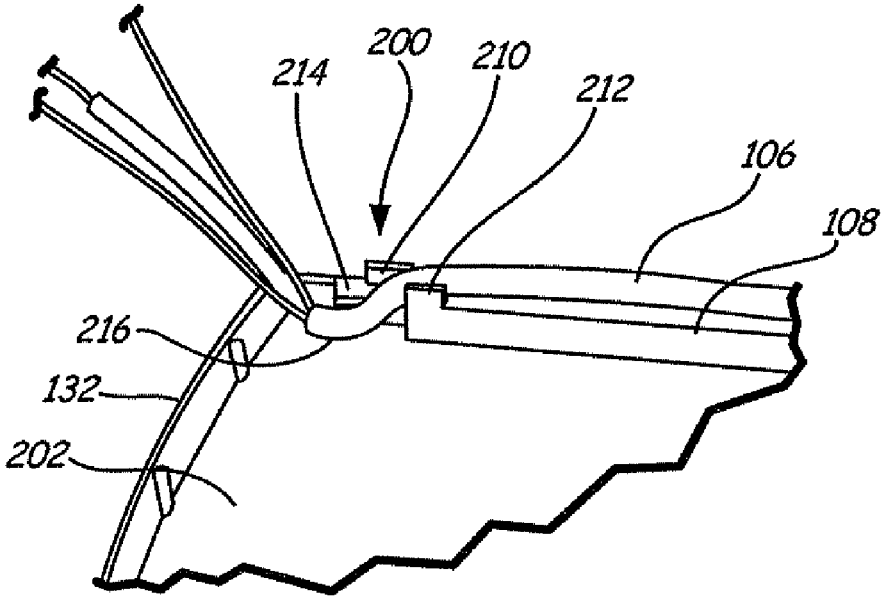
Figure 2D:
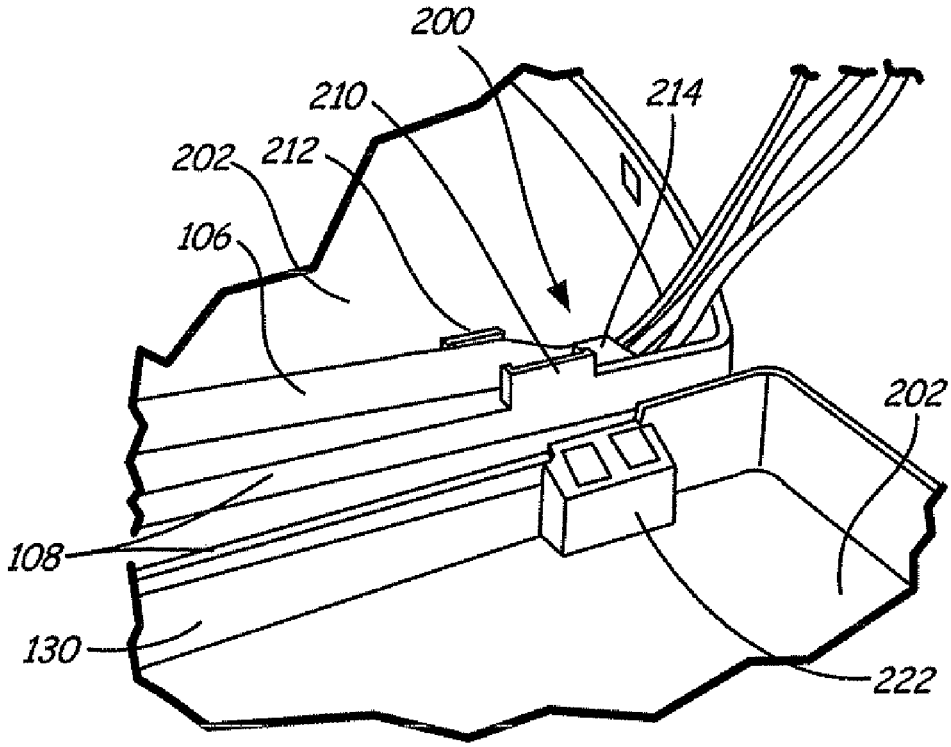

FIG. 2A is a perspective view of a USB cable strain relief 200 in accordance with one aspect and example embodiment of the present invention. FIGS. 2B, 2C and 2D are perspective views of housing 132 and show steps of placing the USB cable 106 into the USB cable strain relief 200. In FIG. 2A, USB cable 106 lies in a portion of groove 108 formed in the lower housing section 132 of housing 102. A portion of cavity 202 formed by the lower housing section 132 is also shown.

In FIG. 2A, the strain relief 200 is illustrated as an outer cable clamp 210, an opposed inner cable clamp 212, an upper cable clamp 214 and a lower cable clamp 216. The clamps 210-216 are positioned such that the cable 106 fits tightly between them and is securely held in place. In the embodiment shown in FIG. 2A, clamps 210-216 are shown as generally flat protrusions which are molded with lower housing section 132. However, the present invention is not limited to such a configuration.

A conventional strain relief for a USB cable is formed with a molded portion (or "boot") fabricated at one end of the cable. The molded portion tightly fits in an opening of the housing and prevents a user from over stretching the cable. However, due to typical molding process limitations, the typical tolerance for the position of the strain relief element is +/−2 mm. With such a large tolerance, it is difficult to fabricate a cable which can be stored within the housing. This is because the cable may be too long, or too short, relative to the portion of the housing in which the plug end of the cable is stored. Further, the molded strain relief requires a relatively large volume which increases the dimensions of the enclosure. In contrast, the strain relief 200 configuration shown in FIG. 2A does not require a significant volume and is well suited for a slim enclosure. Further, the strain relief 200 does not require a molded feature on the cable and is not susceptible to problems associated with tolerance and the placement of the molded feature discussed above. The strain relief 200 fixes the cable in six degrees of freedom to prevent a user from over stretching the cable and causing damage.

FIGS. 2B-2D show steps of placing the cable 106 into the strain relief 200. In cable clamp 214, the cable 106 is laid in groove 108 and placed between cable clamps 210 and 212. As illustrated in FIG. 2C, the cable 106 is then moved downward and also placed between cable clamps 214 and 216. In FIG. 2D, the upper section 130 of housing 102 is shown. This also includes a portion of cavity 202. Once the cable 106 is positioned between cable clamps 210-216, the upper housing section 130 is mounted to the lower housing section 132. Upper housing section 130 includes a press down knob 222 which is molded therein. Press down knob 222 further presses against cable 106 when the housing 102 is completely closed to further increase the robust nature of the design. The tolerance problems mentioned above with a strain relief molded onto the cable 106 are eliminated because the length and position of the cable 106 can be adjusted during the installation process.

Figure 3A:
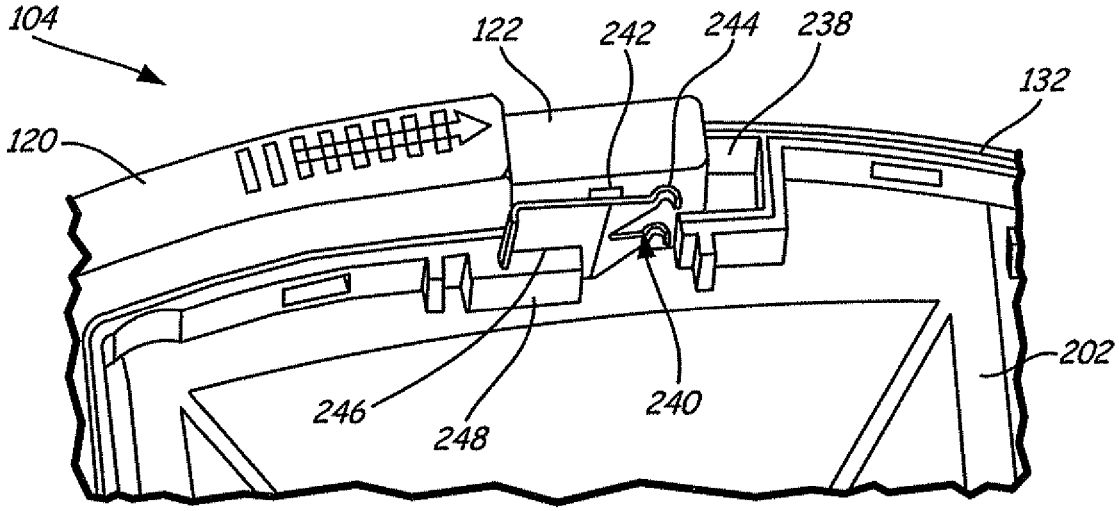
FIGS. 3A and 3B are partial cut-away views of a portion of the lower (or upper) housing sections receiving the USB plug storage recess.
Figure 3B:
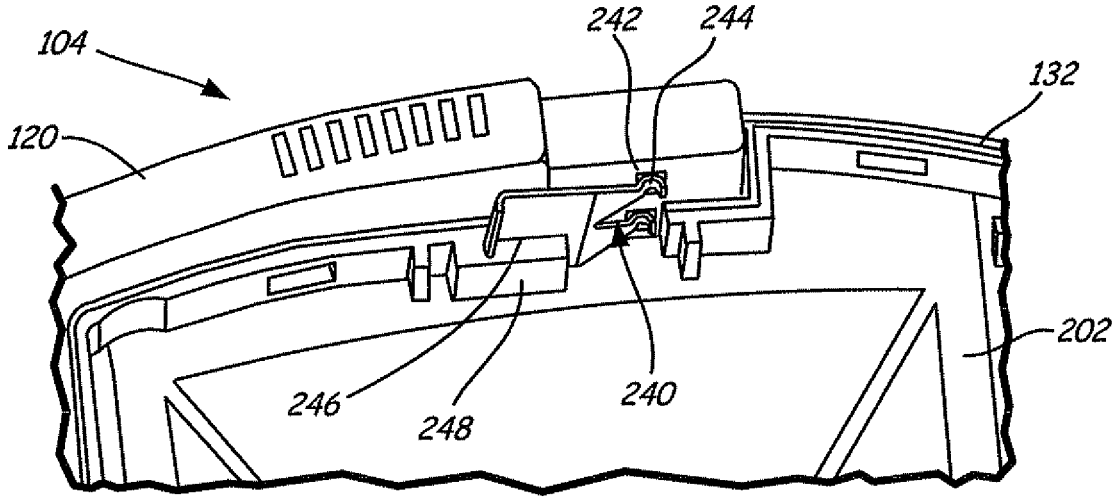
Figure 3C:
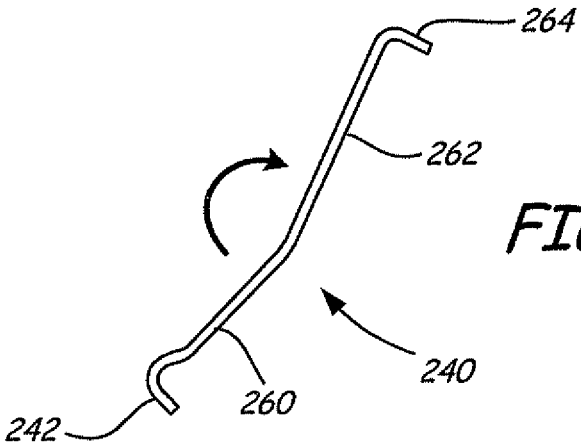
FIG. 3C is a cross-sectional view of spring clip in an energized position.

FIG. 3A is a partial cutaway view of lower housing section 132. As discussed above, the USB plug 104 can be stored within the housing 102. Plug 104 fits within plug storage recess 238 formed in upper and lower housing sections 130 and 132. A spring clip 240 includes two protrusions 244 which fit into recesses 242 in connector portion 122 of USB plug 104. Recesses 242 are standard recesses associated with USB connectors. Spring clip 240 fits into a slot 246 of spring mount 248. Spring mount 248 is molded into section 132. FIG. 3A also illustrates the plug storage recess 238 which is formed in upper section 130. In such a configuration, the identification numeral 132 in FIG. 3A is replaced with the number 130 identifying upper housing section 130. Upper housing section 130 also contains a plug storage recess 238 along with spring mount 248 and slot 246 to receive spring clip 240. USB plug 104 is slid into plug storage recess 238 as illustrated in FIG. 3A such that two protrusions 244 engage recesses 242 thereby securing the USB plug 104 in plug storage recess 238. The spring clip 240 can be formed of stainless steel or the like to improve reliability. FIG. 3C is a cross-sectional view of spring clip 240 in an energized state. Spring clip 240 includes recesses 242, armatures 260, base section 262 and end section 264. Base section 262 and end section 264 are securely held in slot 246 of spring clip mount 248. The spring mount 240 is bent 160° as illustrated by the arrow in FIG. 3C to provide a desired pre-load force. The angle of the bend can be calculated and designed to achieve a smooth latching force when locking and releasing the USB plug 104. This configuration reduces the space required to store the plug 104 and holds the plug more securely than a friction fit which is also subject to wear.

Figure 4:
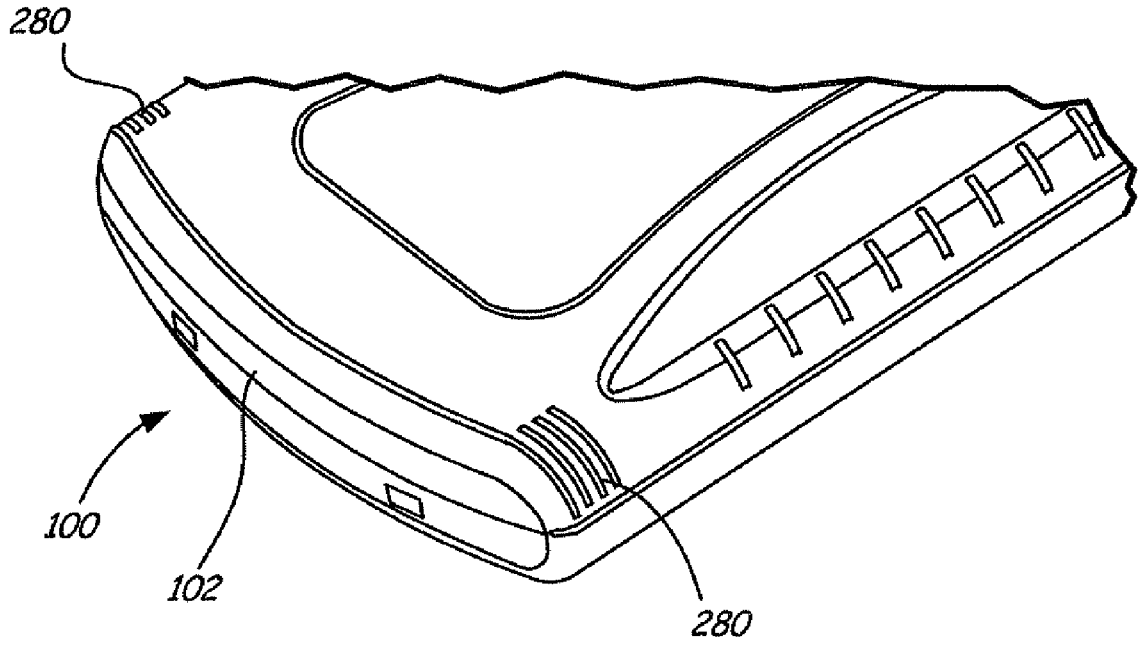
FIG. 4 is a partial view of the housing of FIG. 1 showing shock absorbing features.

FIG. 4 is a perspective view of a portion of housing 102 of storage device 100 and illustrates recesses 280 which are molded into the housing 102. The recesses 280 are configured to absorb impact energy during a shock, such as experienced when storage device 100 is dropped. Recesses 280 allow slight deformation of the housing 102 to thereby absorb the impact energy. This reduces the energy imparted to the internal storage unit 110 and also reduces the stress applied to the housing 102. The recesses 280 are formed by a plurality of recesses molded into the housing 102. However, other recess configurations can be employed and the invention is not limited to those illustrated. In this specific configuration, the recesses are formed by a plurality of elongate parallel recesses.

The present invention provides a housing for a storage unit which offers a relatively slim design. For example, the housing can be configured to contain a 1.8 inch hard disc drive with a USB plug cable. The storage unit can be in accordance with any technology and is not limited to a disc storage unit. The shock recesses improve shock robustness of the device while the stress relief feature reduces the space required by conventional cable stress relief configurations. A spring latch mechanism reduces the space required to store the cable and also improved long term reliability. The USB plug is curved (see, for example, FIG. 3A) to match a curvature in the housing. The cable is received in a cable recess along the side of the housing and secured therein to also provide easy storage. The stress relief features clamp the cable in six degrees of freedom to prevent cable fatigue or stress when pulled by a user. The latch used to secure the USB plug is pre-loaded with a 160° bend to provide a smooth latching and releasing motion.

Although the present invention has been described with reference to preferred embodiments, workers skilled in the art will recognize that changes may be made in form and detail without departing from the spirit and scope of the invention.

What is claimed is:

1. A storage device, comprising:

a housing having a cavity formed therein which contains a storage unit;

a Universal Serial Bus (USB) plug;

a USB cable having a distal end electrically connected to the USB plug located outside of the cavity of the housing and a proximal end connected to the storage unit located in the cavity, wherein the proximal end of the USB cable enters the cavity at a USB cable stress relief mount formed in the housing;

the USB cable stress relief mount, comprising:

a first USB cable clamp formed in the housing;

a second USB cable clamp formed in the housing and opposed to the first USB cable clamp;

a third USB cable clamp formed in the housing, the third USB cable clamp positioned at an angle with the first and second USB cable clamps; and wherein proximal end of the USB cable is positioned between, and is secured by, the first, second and third USB cable clamps.

2. The apparatus of claim 1 wherein in the first, second and third USB cable clamps of the USB stress relief mount are molded in the housing.

3. The apparatus of claim 2 wherein the first, second and third USB cable clamps are molded in a partial section of the housing and wherein the housing is formed in two sections and the first, second and third USB cable clamps are molded in a first section of the housing.

4. The apparatus of claim 3 wherein the stress relief mount includes a fourth USB cable clamp formed in a second section of the housing, the fourth USB cable clamp arranged to oppose the third USB cable clamp.

5. The apparatus of claim 1 including a shock absorption feature molded into the housing.

6. The apparatus of claim 5 wherein the shock absorption feature comprises a plurality of recesses molded into the housing.

7. The apparatus of claim 6 wherein the plurality of recesses comprise a plurality of elongate recesses which are substantially parallel.

8. The apparatus of claim 1 including a recess formed in the housing arranged to receive the USB plug whereby a connector portion of the USB plug is completely enclosed in the recess of the housing.

9. The apparatus of claim 8 including a cable recess extending along a side of the housing between the cable stress relief mount and the recess, the cable recess configured to receive the USB cable therein.

10. The apparatus of claim 8 wherein the recess is curved along a profile of the housing.

11. The apparatus of claim 10 wherein a housing portion of the USB plug is curved and substantially matches profile of the housing at the recess.

12. The apparatus of claim 8 including a spring clip arranged to secure the USB plug in the recess in the housing.

13. The apparatus of claim 12 wherein the spring clip includes at least one tab configured to be received in a recess in a connector of the USB plug to thereby secure the USB plug in the recess.

14. A method of coupling a USB cable having a proximal end coupled to a housing of a storage device and a distal end coupled to a USB plug, comprising:

securing the proximal end of the USB cable to the housing at a USB cable stress relief mount formed in the housing, by:

placing the proximal end of the USB cable between a first USB cable clamp and a second USB cable clamp of a USB cable stress relief mount of the housing, the second USB cable clamp opposed to the first USB cable clamp and positioned to secure the cable therebetween, the USB cable extending between the storage unit in the housing at the proximal end and the USB plug at the distal end;

placing the proximal end of the USB cable between a third USB cable clamp and a fourth USB cable clamp, the third and fourth USB cable clamps arranged at an angle with the first and second USB cable clamps, the third USB cable clamp opposed to the fourth USB cable clamp and positioned to secure the proximal end of the USB cable therebetween;

wherein the USB cable is secured from movement in six degrees of freedom using the first, second, a third and a fourth USB cable clamps.

15. The method of claim 14 wherein the first, second and third USB cable clamps are molded in a partial section of the housing wherein the housing is formed in two section and the first, second and third USB cable clamps are molded in a first section of the housing.

16. The method of claim 14 including molding in the first, second and third USB cable clamps into the housing.

17. The method of claim 16 including providing a recess formed in the housing arranged to receive the USB plug whereby a connector portion of the USB plus is completely enclosed in the recess of the housing.

18. The method of claim 17 wherein the recess is curved along a profile of the housing and a housing portion of the USB plug is curved and substantially matches profile of the housing at the recess.

* * * * *

UNITED STATES PATENT AND TRADEMARK OFFICE

CERTIFICATE OF CORRECTION

PATENT NO. : 7,578,698 B1
APPLICATION NO. : 12/111365
DATED : August 25, 2009
INVENTOR(S) : Thia et al.

It is certified that error appears in the above-identified patent and that said Letters Patent is hereby corrected as shown below:

Column 6, line 28, delete "the USB plus" and insert --the USB plug--

Signed and Sealed this

Ninth Day of March, 2010

David J. Kappos

David J. Kappos
*Director of the United States Patent and Trademark Office*